United States Patent [19]

Yonemoto et al.

[11] Patent Number: 4,439,811

[45] Date of Patent: Dec. 25, 1984

[54] APPARATUS FOR DECELERATING ELEVATOR AT TERMINATING FLOOR

[75] Inventors: Masashi Yonemoto, Nagoya; Ryuichi Kajiyama, Inazawa, both of Japan

[73] Assignee: Mitsubishi Denki Kabushiki Kaisha, Japan

[21] Appl. No.: 464,668

[22] Filed: Feb. 7, 1983

[30] Foreign Application Priority Data

Feb. 8, 1982 [JP] Japan ..... 57-18350

[51] Int. Cl.[3] ..... B66B 1/30

[52] U.S. Cl. ..... 187/29 R; 340/19 R

[58] Field of Search ..... 187/29 R

[56] References Cited

U.S. PATENT DOCUMENTS

| | | | |
|---|---|---|---|
| 3,779,346 | 12/1973 | Winkler | 187/29 R |
| 4,128,142 | 12/1978 | Satoh et al. | 187/29 R |
| 4,351,416 | 9/1982 | Terazono et al. | 187/29 R |
| 4,354,576 | 10/1982 | Kajiyama | 187/29 R |
| 4,354,577 | 10/1982 | Yonemoto | 187/29 R |
| 4,356,896 | 11/1982 | Tamura et al. | 187/29 R |
| 4,373,612 | 2/1983 | Caputo et al. | 187/29 R |

FOREIGN PATENT DOCUMENTS

| | | |
|---|---|---|
| 2062297 | 5/1981 | United Kingdom . |
| 2064819 | 6/1981 | United Kingdom . |

OTHER PUBLICATIONS

American National Standard Institute/American Society of Mechanical Engineers-A17.1-191 American National Standard Safety Code for Elevator, Dumbwaiter, Escalator and Moving Walks, Rule 209.1 and 209.2.

*Primary Examiner*—J. V. Truhe
*Assistant Examiner*—Paul Shik Luen Ip
*Attorney, Agent, or Firm*—Leydig, Voit, Osann, Mayer and Holt, Ltd.

[57] ABSTRACT

An apparatus for decelerating an elevator at a terminating floor having a plurality of terminating detectors successively provided in the vicinity of the terminating floor for generating a terminating deceleration command value gradually decreasing upon operation of the detectors when the cage of the elevator approaches the terminating floor which comprises; a pulse generator for generating pulses corresponding to the moved distance of the cage; memories for storing the distances from the terminating floor to said respective terminating detectors; a counter for setting the distance information of the detectors of said memories upon operation of the detectors and counting the output pulses of said pulse generator, thereby subtracting the pulses from the set value; and a distance-to-speed converter for calculating the terminating deceleration command value corresponding to the output of said counter.

9 Claims, 8 Drawing Figures

Vcc
28
27
16b
21b
45
44a
17a
OSM
461
22a
G
491
I
50
51
52
MEMORY DEVICE
MPX
SUBTRACTION COUNTER
DISTANCE /SPEED CONVERTER
D/A
Vs
481
L
17b
18a
462
OSM
22b
23a
482
492
G
MEMORY DEVICE
MPX
20b
OSM
25b
465
485
495
G
MEMORY DEVICE
MPX
47

APPARATUS FOR DECELERATING ELEVATOR AT TERMINATING FLOOR

BACKGROUND OF THE INVENTION

The present invention relates to an improved apparatus for generating a decelerating command at the terminating floor of an elevator.

The speed of an elevator cage is controlled in accordance with a speed command value. A terminating deceleration command value is produced for protecting the speed command value at the terminating floor. This is shown in FIGS. 1 to 3.

In FIGS. 1 to 3, numeral 1 designates a speed instructing unit which generates a normal speed command value $V_p$, numeral 2 a selecting circuit which selects either a smaller value than the speed command value $V_p$ or a terminating deceleration command value $V_s$, which will be described later, numeral 3 an adder which adds the output of the selecting circuit 2 and a speed signal, which will be described later, and which outputs a deviation signal between the output of the selecting circuit 2 and the speed signal, numeral 4 a speed controller which outputs a speed control signal in response to the deviation signal, numeral 5 a thyristor converter which comprises thyristors and which has its output voltage controlled in accordance with the speed control signal, numeral 6 an armature of a winding D.C. motor which is connected to the thyristor converter 5, numeral 7 a tachometer generator which is coupled directly to the armature 6 and which produces a speed signal which is inputed to the adder 3, numeral 8 a sheave for a winch which is driven by the armature 6, numeral 9 a deflector wheel, numeral 10 a main cable which is engaged with the sheave 8 and the deflector wheel 9, numeral 11 a cage which is coupled to one end of the main cable 10, numeral 12 a balance weight which is similarly coupled to the other end of the main cable 10, numeral 13 a cam which is fixedly secured to the case 11, numeral 14 the top floor, numeral 15 the bottom floor, numerals 16 to 20 terminating detectors which are respectively provided in an elevational passage so as to be sequentially disposed toward the top terminating floor 14 and which successively operate when each is engaged with the cam 13, numerals 16*a* to 20*a* their normally closed contacts (in FIG. 2), numerals 21 to 25 terminating detectors which are similarly respectively provided in the elevational passage so as to be sequentially disposed toward the bottom terminating floor 15, numerals 21*a* to 15*a* their normally closed contacts (in FIG. 2), and numeral 26 a terminating deceleration instructing unit which produces the terminating deceleration command value $V_s$ in accordance with the outputs of the detectors 16 to 26. In FIG. 2, numeral 27 designates an ascending operation relay contact which closes when the cage 11 ascends, numeral 28 a descending operation relay contact which closes when the cage 11 similarly descends, numeral 29 an operational amplifier, characters $R_1$ to $R_5$, $R_{11}$ to $R_{15}$ and $R_s$ resistors, character C a capacitor, and character $-V_{ee}$ a D.C. negative power voltage.

As shown in FIG. 3, since the voltages $V_p$ and $V_s$ are normally set to the relationship of $V_p < V_s$, the selecting circuit 2 selects the speed command value $V_p$, the speed controller 4 operates in accordance with this speed command value $V_p$, thereby operating the thyristor coverter 5, which in turn applies a voltage to the armature 6 of the motor. Thus, the armature 6 rotates, thereby running the cage 11 through the sleeve 8 and the main cable 10. The speed of the case 11 is detected by the tachometer generator 7, the speed signal of the tachometer generator 7 is compared by the adder 3 with the speed command value $V_p$, and the cage 11 is accurately controlled in accordance with the speed command value $V_p$.

When the cage 11 is, on the other hand, ascending along an intermediate floor, the ascending operation relay contact 27 remains closed, and the terminating detectors 16 to 20 are not activated. Accordingly, their contacts 16*a* to 20*a* are all closed. Therefore, the terminating deceleration command value $V_s$ becomes, as shown in FIG. 3, $V_s = V_1$. When the cage 11 continues to ascend and reaches a point $S_1$, the detector 16 engages with the cam 13, allowing the contact 16*a* to open. Thus, the input resistor $R_1$ of the amplifier 29 is disconnected from the power voltage $-V_{ee}$, and the terminating deceleration command value $V_s$ decrease, as shown in FIG. 3, at a time constant which is determined by the resistor $R_s$ and the capacitor C and eventually becomes a voltage $V_2$. When the cage 22 further ascends and reaches a point $S_2$, the detector 17 operates, allowing the contact 17*a* to open. Thus, the terminating deceleration command value $V_s$ similarly decreases at the time constant and eventually becomes a voltage $V_3$. Similarly, the detectors 18, 19 operate, and the terminating deceleration command value $V_s$ decreases. When the cage 11 thus finally reaches a point at a distance $S_5$ before the floor 14, the detector 20 operates, allowing the contact 20*a* to open, and the terminating deceleration command value $V_s$ decreases toward zero.

When the speed command value $V_p$ does not decreases and the values $V_p$ and $V_s$ becomes $V_p < V_s$ even if a malfunction occurs in the speed instructing unit and the cage 11 approaches the vicinity of the top floor 14, the selecting circuit 2 selects the terminating deceleration command value $V_s$. Thus, the cage 11 decelerates and stop at the top floor 14 in accordance with the terminating deceleration command value $V_s$.

In case of the descending operation, the operation is performed similarly to the case of the ascending operation except that the descending operation relay contact 28 closes and the terminating detectors 21 to 25 operate.

In this case, the deceleration of the terminating deceleration command value $V_s$ should be set as low as possible so as to protect the thyristor and the motor against an excessively large current at the decelerating time. For that purpose, a number of terminating detectors 16 to 25 should be provided. Since the detectors 16 to 25 are, on the other hand, restricted in their disposition, the number of the detectors should be limited. Accordingly, the deceleration of the terminating deceleration command value $V_s$ cannot be reduced to a sufficient value, and the thyristor and the motor employed become rigid and expensive.

SUMMARY OF THE INVENTION

The present invention enables the avoidance of the above-mentioned complexity and high cost and has for its object to provide an apparatus for decelerating an elevator at the terminating floor, which generates a pulse from terminating detectors in response to the moving distance of a cage, which sets a value responsive to the distance from the terminating floor at the terminating detectors when each detector operates, which counts the pulses and subtracts the pulse from the set value, and which calculates the terminating deceleration command value from the subtracted value, thereby enabling the deceleration of the terminating deceleration command value to be set to a sufficiently low value and requiring a lesser number of terminating detectors.

In order to achieve the above and other objects, there is provided according to the present invention an apparatus for decelerating a cage at a terminating floor, having a plurality of terminating detectors successively operate to generate a terminating deceleration command value which gradually decreases upon successive operation of the terminating detectors when the cage approaches the terminating floor, comprising a pulse generator for successively generating pulses corresponding to the moved distance of the cage, a memory for storing the distances from the terminating floor to the successive terminating detectors, a counter for setting the output of the memory corresponding to the operation of the detector upon operation of the detector and for counting the output pulse of the pulse generator to subtract the pulse from the set value, and a distance-to-speed converter for calculating a terminating deceleration command value corresponding to the output of the counter.

DETAILED DESCRIPTION OF THE PREFERRED EMBODIMENTS

Figure 1:
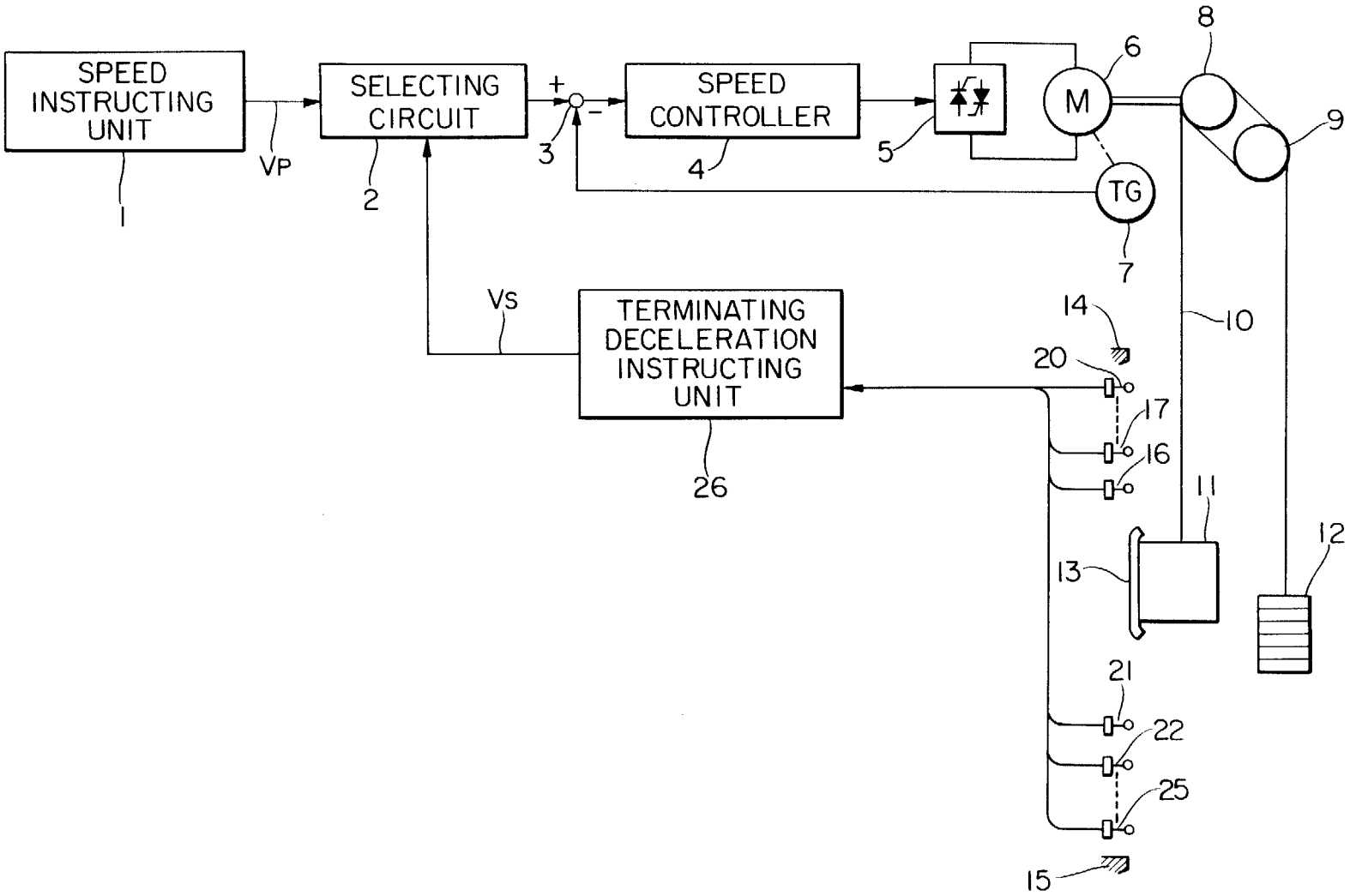
FIG. 1 PRIOR ART
FIG. 1 is a diagram showing the construction of a conventional apparatus for decelerating an elevator at a terminating floor.

An embodiment of the invention will be described below conjunction with the accompanying drawings, wherein the same symbols indicate the same or corresponding parts in FIG. 1.

Figure 4:
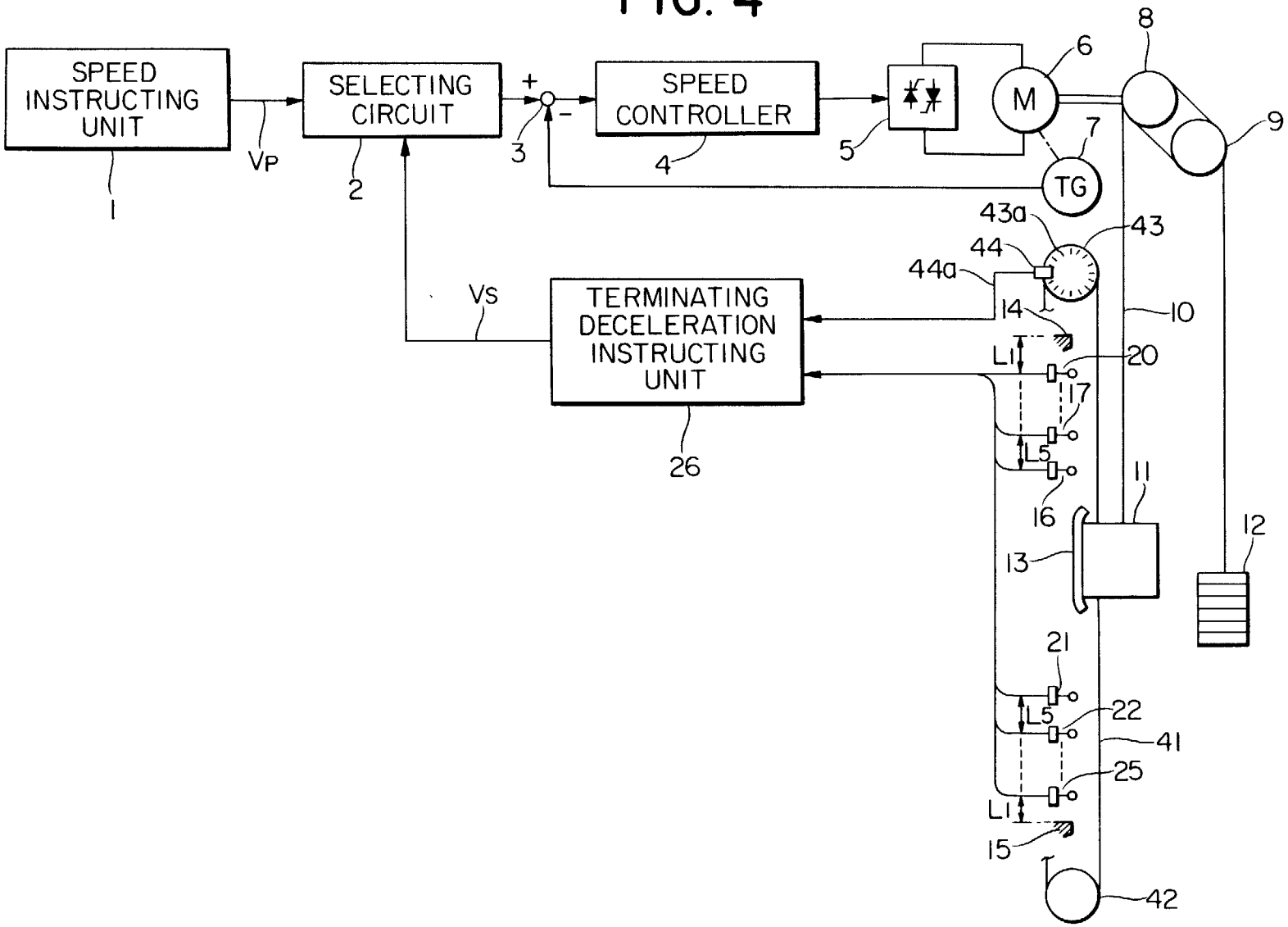
FIG. 4 is a diagram illustrating the construction of an apparatus for decelerating an elevator at a terminating floor according to an embodiment of the present invention.

In FIG. 4, numeral 41 designates a rope which is coupled at both ends to a cage 11 in an endless loop and which is disposed in an elevation passage, numeral 42 a tension wheel which imparts a downward tension on the rope 41, numeral 43 a disc which is driven by the rope 41 and in which are formed fine holes 43*a* at equal intervals on the periphery thereof, and numeral 44 a pulse generator which is provided on the disc 43 and which generates a pulse 44*a* every time a fine hole 43*a* of the disc 43 transverses the pulse generator, thereby creating a pulse train which is applied to a terminating deceleration instructing unit 26.

Figure 5:
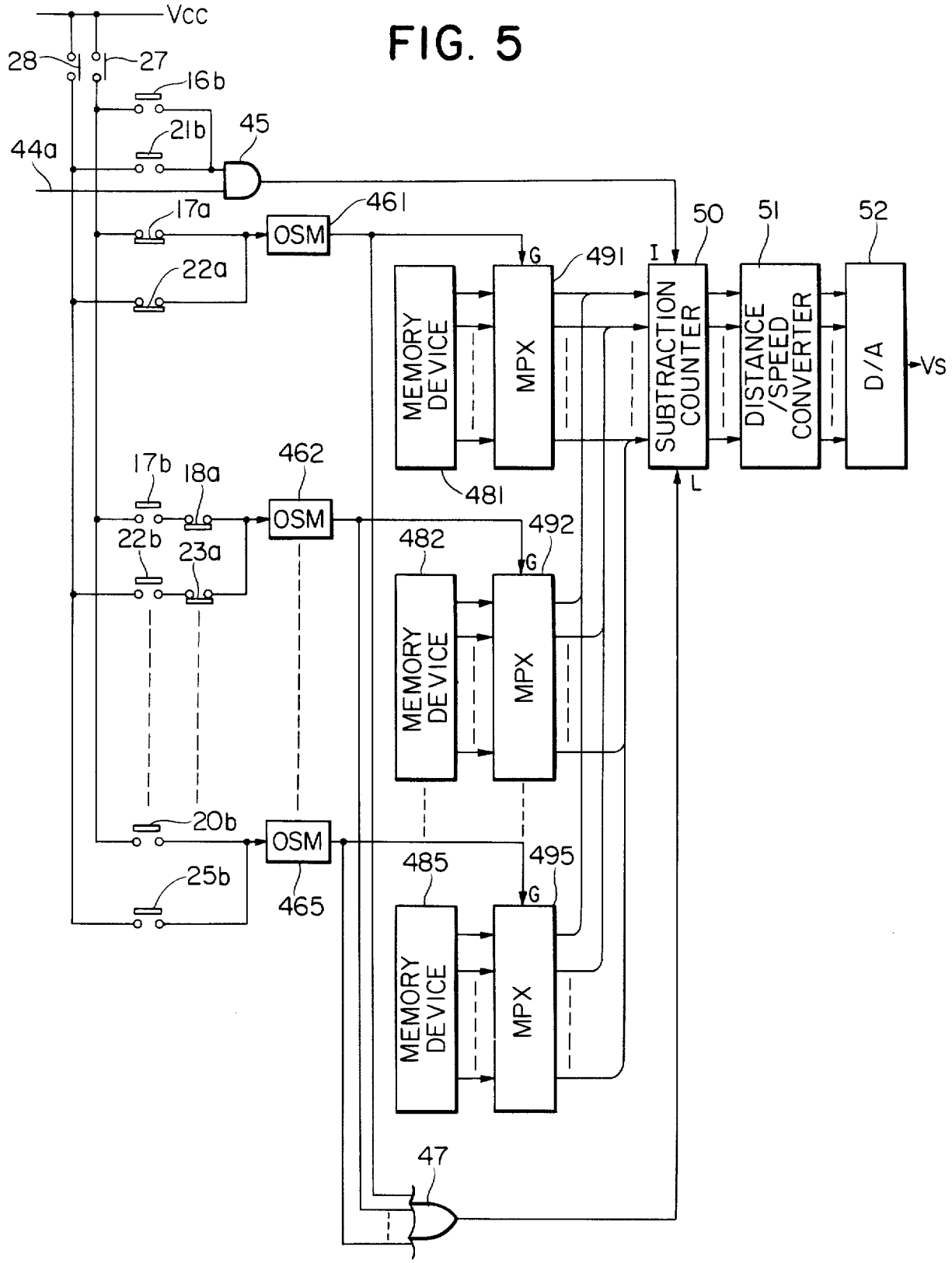
FIG. 5 is a block circuit diagram illustrating terminating detectors, a pulse generator and terminating deceleration instructing unit section in FIG. 4.

In FIG. 5, character $V_{cc}$ designates a D.C. positive power voltage, numerals 16*b* to 20*b* normally open contacts of the respective terminating detectors 16 to 20 (in FIG. 4), numerals 21*b* to 26*b* normally open contacts of the respective terminating detectors 21 to 25, numeral 45 an AND gage, numerals 461 to 465 monostable elements, hereinafter referred to as "OSM", which produce an output "H" for a predetermined period of time when its input becomes "H", numeral 47 an OR gate, numerals 481 to 485 memory devices which respectively store data (binary) corresponding to the distances $S_1$ to $S_5$ from the terminating floors 14 and 15 to the terminating detectors 16 to 20 and 21 to 25, numerals 491 to 495 multiplexers, hereinafter referred to as "MPX", which respectively transfer the contents from the memories 481 to 485 when an input G becomes "H", numeral 50 a subtraction counter which is preset to a new value according to the inputs from the MPX 491 to 495 when an input L becomes "H" and which respectively subtracts the preset value by the pulse of an input I, numeral 51 a distance-to-speed converter which has a read-only memory (ROM) for storing speed command values corresponding to the distances, and numeral 52 a distance-to-speed converter which converts a digital amount into an analog amount and which generates a terminating deceleration command value $V_s$. The remaining components not mentioned above are the same as those in FIG. 1. The cam 13 has a length which can simultaneously engage the detectors 16 to 20 or 21 to 25. The relation of the disposition (or distance) of the detectors 16 to 20 to the top floor 14 is the same as that of the disposition (or distance) of the detectors 21 to 25 to the bottom floor 15.

Figure 2:
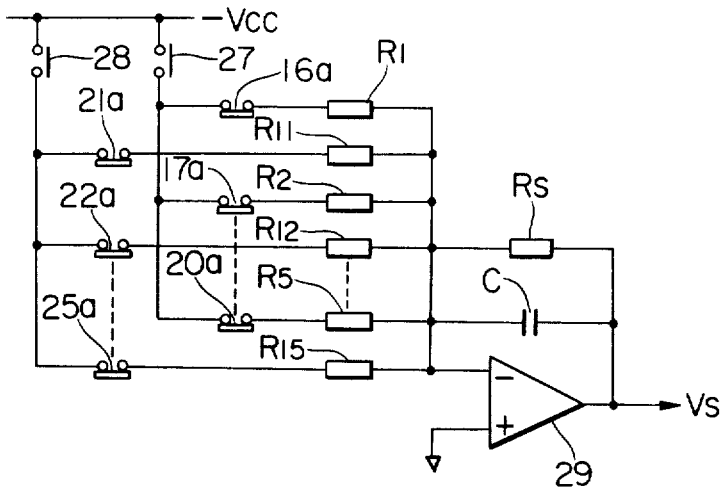
FIG. 2 PRIOR ART
FIG. 2 is a circuit diagram of the terminating detectors and the terminating deceleration instructing unit section in FIG. 1.
Figure 3:
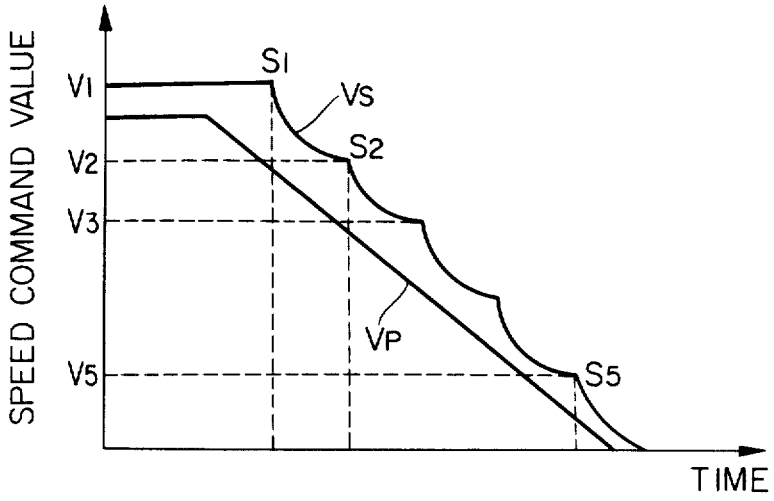
FIG. 3 PRIOR ART
FIG. 3 is a diagram showing speed command value vs. time curves.

For the case where all the detectors are not simultaneously engaged by the cam 13, electric circuits may be utilized to maintain the contacts in an open or closed state. For example, in FIG. 2, the contacts 16*a*, 17*a*, . . . , 20*a* are kept open by said electric circuits and are caused to close only when the cage moves downward and the cam 13 comes into contact with the detectors 16, 17, . . . , 20, respectively.

The operation of this embodiment will be described here below.

Figure 6:
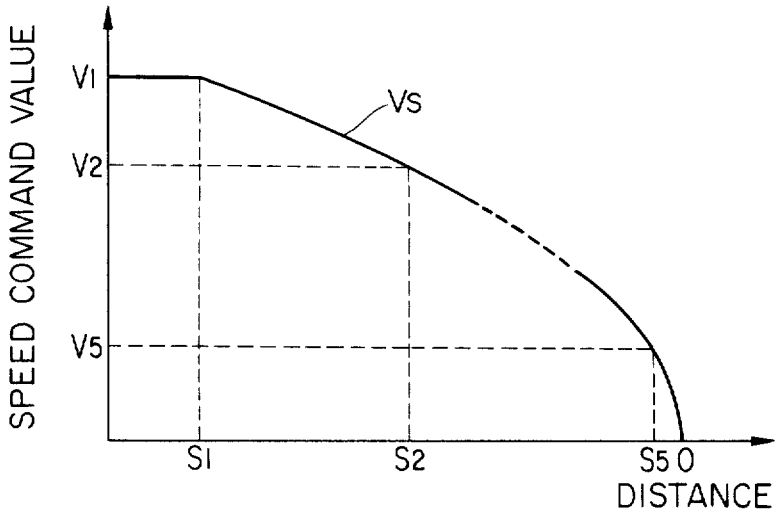
FIG. 6 is a diagram showing a speed command value vs. distance curve.

When the cage 11 starts ascending from any one intermediate floor, the ascending operation relay contact 27 closes. Since the detector 17 is not yet operated at this time and its contact 17*a* is closed, the output of the OSM 461 becomes "H" for a predetermined short time (e.g., several sec.), and the MPX 491 will be activated. The output of the OR gate 47 simultaneously becomes "H", and the content of the memory 481 is accordingly preset in the counter 50. Since a binary number corresponding to the distance $S_1$ shown in FIG. 6 is stored in the memory 481, the output of the counter 50 indicates the distance $S_1$, and this output is inputted to the address line of the ROM which forms the distance-to-speed converter 51. On the other hand, a function of distance S vs. speed command value V shown in FIG. 6, generally $V=\sqrt{2\alpha S}$, where $\alpha$ represents a deceleration, is stored in the converter 51, and a binary number corresponding to the speed command value $V_1$ is outputted from its data line. The D/A converter 52 converts the binary number into an analog amount, and sets it to the terminating deceleration command value $V_s=V_1$.

Figure 7:
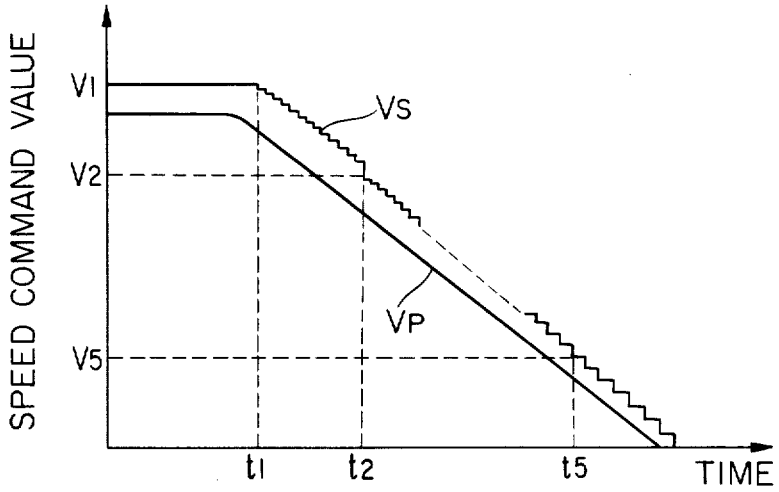
FIG. 7 is a diagram showing speed command value vs. time curves.

When the cage 11 is continuously ascending and the detector 16 is engaged with the cam 13 at a time $t_1$ in FIG. 7, its contact 16*b* closes. Accordingly, the AND gate 45 is opened, and its output becomes a pulse 44*a*. Thus, a pulse is substracted from the distance $S_1$ of the binary number thus preset in the counter, and the counted value is delivered to the address line of the converter 51. The converter 51 extracts the speed command value corresponding to its value every time the counted value of the counter 50 is altered, the speed command value is outputted through the converter 52, and the terminating deceleration command value $V_s$ starts decreasing as shown in FIG. 7.

When the cage 11 further ascends and the detector 17 is engaged with the cam 13 at a time $t_2$ in FIG. 7, its contact 17*b* closes. Since the contact 18*a* is closed at this time, the output of the OSM 462 becomes "H" for a predetermined short time. Thus, the MPX 492 and the OR gate 47 similarly operate, and the content of the memory 482 is transfered to the counter 50. Since the binary number corresponding to the distance $S_2$ shown in FIG. 6 is stored in the memory 482, the output of the counter 50 indicates the distance $S_2$, and the terminating deceleration command value $V_s$ is similarly corrected to $V_s = V_2$. In this case, a slight difference would be produced at the command value $V_s$ as shown in FIG. 7, but this is not practically affected.

Since the detector 16 is engaged with the cam 13 even after the time $t_2$, the counter 50 continues subtracting the pulses 44*a*, and the command value $V_s$ further continues decreasing.

When the detector 20 is eventually engaged with the cam 13 at a time $t_5$ and its contact 20*b* is closed, the command value $V_s$ is similarly corrected to $V_s = V_5$. Thereafter, the command value $V_s$ is reduced toward zero by the pulses 44*a*.

In case of the descending operation, the operation is similarly to the ascending operation except that the descending operation relay contact 28 is closed and the detectors 21 to 25 are operated. At this time, the memories, the MPX, the counter, the distance-to-speed converter and the D/A converter are employed in the same manner as described above.

Since the detection of the position in the zones between one terminating detector and an adjacent terminating detector is related to the number of directly generated pulses, the position of the cage as described above is directly proportional to the number of terminating detectors and pulses generated which indirectly implies that the number of terminating detectors has been increased accordingly.

Figure 8:
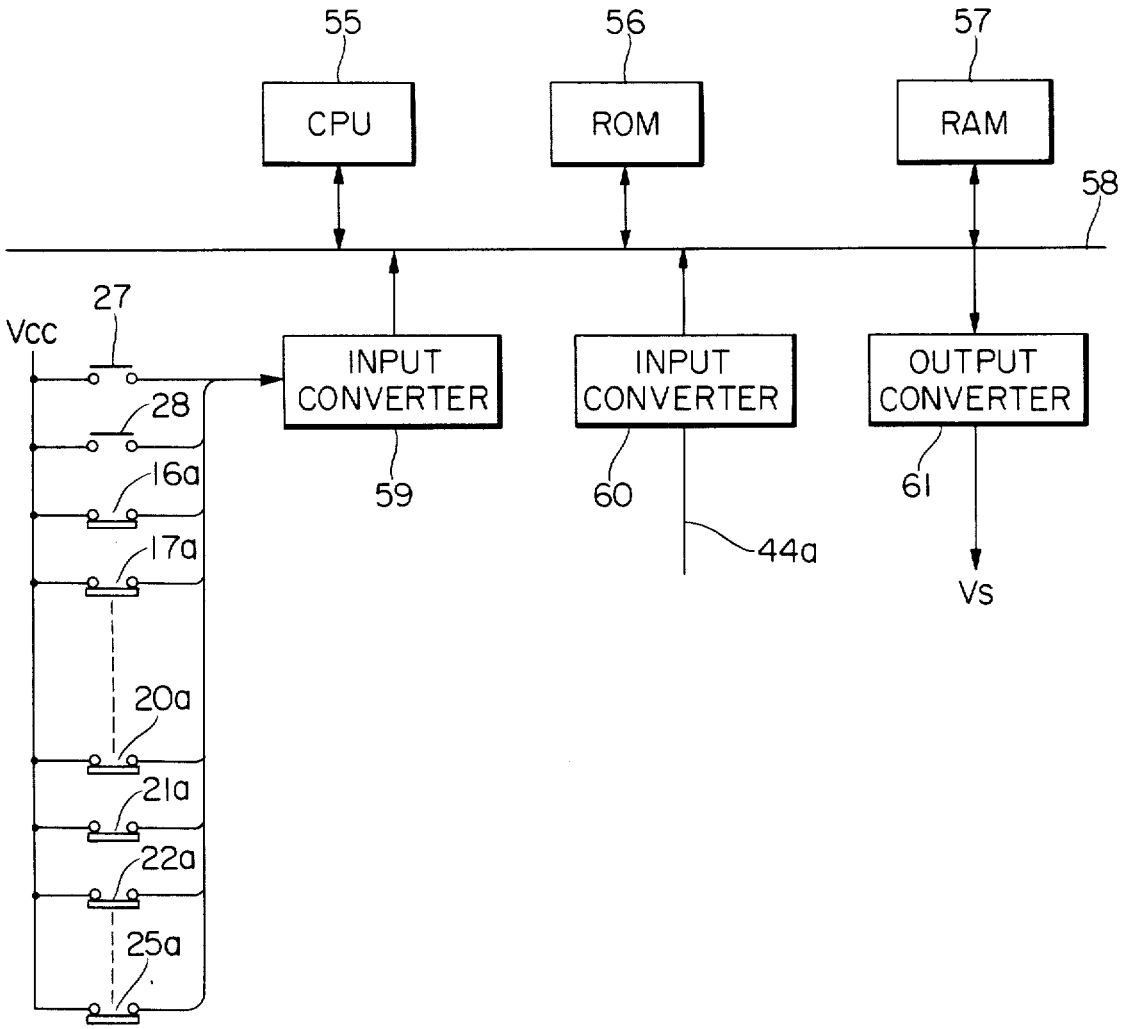
FIG. 8 is a block circuit diagram illustrating the construction of the apparatus according to another embodiment of the present invention, corresponding to FIG. 5.

FIG. 8 shows another embodiment of the apparatus of the invention, wherein the function in FIG. 5 is performed by a computer such as a microcomputer.

In FIG. 8, numeral 55 designates a central processing unit, hereinafter referred to as a "CPU", numeral 56 a read-only memory, whereinafter referred to as a "ROM", which stores programs and fixed value data, numeral 57 a random access memory, hereinafter referred to as a "RAM", which temporarily stores data, numeral 58 a bus such as an address bus or a data bus, numeral 59 an input converter which forms a converter for allowing the CPU 55 to read the operating states of the ascending operation relay contact 27 and the descending operation relay contact 28, numeral 60 an input converter which forms a converter for similarly reading the pulses 44*a*, and numeral 61 an output converter for converting the digital command value $V_s$ calculated by the CPU 55 into an analog value.

The operation states of the detectors 16 and 25 are read to the CPU 55 through the converter 59. The pulse 44*a* is read to the CPU 55 through the converter 60. The value which is calculated through the elements after the AND gate 45 in FIG. 5 is calculated by the CPU 55, the ROM 56 and the RAM 57. The calculated result is outputted as the terminating deceleration command value $V_s$ through the converter 61.

According to the present invention, as mentioned above, a pulse corresponding to the moved distance of the cage is generated, the value corresponding to the distance from the top floor detector is set when the detector is operated, the pulse is subtracted from the set value, and a terminating deceleration command value corresponding to the subtracted value is calculated. Therefore, the deceleration of the terminating deceleration command value can be set to a sufficiently low value while utilizing a minimum number of terminating detectors, as well as allowing the use of inexpensive thyristors and motor.

What is claimed is:

1. An apparatus for decelerating an elevator at a terminating floor having a plurality of terminating detectors successively provided in the vicinity of the terminating floor for generating a terminating deceleration command value gradually decreasing upon operation of the detectors when the cage of the elevator approaches the terminating floor which comprises:

a pulse generator which generates pulses corresponding in number to a moved distance of the cage;

memories which store distances from the terminating floor to respective terminating detectors;

a counter in which the distance information of one of the memories is preset in correspondence with the operation of one of said plurality of terminating detectors when the cage starts an ascending or descending operation, and thereafter the distance information of the memory corresponding to another of said terminating detectors is set when said another terminating detector operates, and which is supplied with said pulses when said one terminating detector detects the presence of the cage, to count said pulses and to subtract the count value from the set value; and a distance-to-speed converter which calculates the terminating deceleration command value corresponding to the output of said counter.

2. An apparatus for decelerating an elevator at a terminating floor as set forth in claim 1, wherein:

the pulses continue to be supplied to said counter from a time at which one of said plurality of terminating detectors firstly operated after the start of the operation detects the presence of the cage until a time at which another of said terminating detectors lastly operated detects the presence of the cage.

3. An apparatus for decelerating an elevator at a terminating floor as set forth in claim 2, wherein:

said counter is preset by an element which produces an output signal for a predetermined time upon the start of the ascending and descending operation of the cage.

4. An apparatus for decelerating an elevator at a terminating floor as set forth in claim 1, wherein:

the terminating detectors are installed in the vicinities of both the top floor and the bottom floor, and said memories, said counter and said distance-to-speed converter are started operating by any of said terminating detectors.

5. An apparatus for decelerating an elevator at a terminating floor as set forth in claim 4, wherein:

a relation of the distances to the top floor of the respective terminating detectors provided in the vicinity of the top floor is equal to that of the distances to the bottom floor of the respective terminating detectors provided in the vicinity of the bottom floor.

6. An apparatus for decelerating an elevator at a terminating floor as set forth in claim 1, wherein:

in accordance with a signal produced upon operation by the cage of a terminating detector, the distance information corresponding to said terminating detector which is a production source of said signal is set in said counter from the memory storing said distance information.

7. An apparatus for decelerating an elevator at a terminating floor as set forth in claim 1, wherein:

said distance-to-speed converter is a memory device which stores a speed command value corresponding to the distance and sequentially outputs speed command values corresponding to the distance signals from said counter.

8. An apparatus for decelerating an elevator at a terminating floor as set forth in claim 1, wherein:

the distance information corresponding to each of said terminating detectors is set in said counter by an element which produces an output signal for a predetermined time in response to the operation of said each terminating detector.

9. An apparatus for decelerating an elevator at a terminating floor as set forth in claim 1, wherein:

the operations of said memories, said counter and said distance-to-speed converter are performed by a computer.

* * * * *